US009057261B2

(12) United States Patent
Walters et al.

(10) Patent No.: US 9,057,261 B2
(45) Date of Patent: Jun. 16, 2015

(54) SYSTEM AND METHOD FOR FRACTURING ROCK IN TIGHT RESERVOIRS

(75) Inventors: Clifford Walters, Milford, NJ (US); Nancy Hyangsil Choi, Fort Worth, TX (US); Michael Edward McCracken, Flower Mound, TX (US); Jeff H. Moss, The Woodlands, TX (US)

(73) Assignee: ExxonMobil Upstream Research Company, Houston, TX (US)

( * ) Notice: Subject to any disclaimer, the term of this patent is extended or adjusted under 35 U.S.C. 154(b) by 449 days.

(21) Appl. No.: 13/578,805

(22) PCT Filed: Feb. 17, 2011

(86) PCT No.: PCT/US2011/025264

§ 371 (c)(1),
(2), (4) Date: Aug. 13, 2012

(87) PCT Pub. No.: WO2011/115723

PCT Pub. Date: Sep. 22, 2011

(65) Prior Publication Data

US 2013/0000908 A1 Jan. 3, 2013

Related U.S. Application Data

(60) Provisional application No. 61/315,493, filed on Mar. 19, 2010.

(51) Int. Cl.

| | |
|---|---|
| ***E21B 43/263*** | (2006.01) |
| ***E21B 43/267*** | (2006.01) |
| *F42B 12/34* | (2006.01) |

(52) U.S. Cl.

CPC ..... *E21B 43/263* (2013.01); *F42B 12/34* (2013.01); *E21B 43/267* (2013.01)

(58) Field of Classification Search

CPC ..... F42B 12/20; F42B 12/34; F42B 3/087; E21B 43/263

See application file for complete search history.

(56) References Cited

U.S. PATENT DOCUMENTS

| | | | | | |
|---|---|---|---|---|---|
| 3,002,454 | A | * | 10/1961 | Chesnut | 166/299 |
| 3,495,532 | A | | 2/1970 | Roberts et al. | |
| 3,674,089 | A | | 7/1972 | Moore | |
| 3,713,487 | A | | 1/1973 | Lozanski | |
| 3,730,274 | A | * | 5/1973 | Brown | 166/299 |
| 3,771,600 | A | * | 11/1973 | Hill | 166/299 |

(Continued)

OTHER PUBLICATIONS

Adushkin, V., et al. (2007) "Features of forming an explosive fracture zone in a hard rock mass", *Journal of Mining Science* vol. 43, No. 3, 273-283.

(Continued)

*Primary Examiner* — Giovanna C Wright
(74) *Attorney, Agent, or Firm* — ExxonMobil Upstream Research—Law Department

(57) ABSTRACT

Methods and systems are provided for fracturing rock in a formation to enhance the production of fluids from the formation. In one exemplary method, one or more wells are drilled into a reservoir, wherein each well comprises a main wellbore with two or more lateral wellbores drilled out from the main wellbore. One or more explosive charges are placed within each of the two or more lateral wellbores, and the explosive charges are detonated to generate pressure pulses which at least partially fracture a rock between the two or more lateral wellbores. The detonations are timed such that one or more pressure pulses emanating from different lateral wellbores interact.

23 Claims, 8 Drawing Sheets

600

(56) References Cited

U.S. PATENT DOCUMENTS

| | | | | |
|---|---|---|---|---|
| 3,797,576 | A | 3/1974 | Azalbert et al. | |
| 3,838,736 | A * | 10/1974 | Driver | 166/299 |
| 3,902,422 | A | 9/1975 | Coursen | |
| 4,200,152 | A | 4/1980 | Foster et al. | |
| 4,248,303 | A | 2/1981 | Charpentier | |
| 4,281,878 | A | 8/1981 | Ricketts | |
| 4,329,925 | A | 5/1982 | Hane et al. | |
| 4,391,337 | A | 7/1983 | Ford et al. | |
| 4,522,260 | A | 6/1985 | Wolcott, Jr. | |
| 4,714,114 | A | 12/1987 | Jones | |
| 4,903,772 | A | 2/1990 | Johnson | |
| 4,976,199 | A | 12/1990 | Beukes et al. | |
| 5,291,956 | A | 3/1994 | Mueller et al. | |
| 5,295,545 | A | 3/1994 | Passamaneck | |
| 5,318,123 | A * | 6/1994 | Venditto et al. | 166/250.1 |
| 5,735,350 | A | 4/1998 | Longbottom et al. | |
| 6,263,984 | B1 * | 7/2001 | Buckman, Sr. | 175/67 |
| 6,446,727 | B1 | 9/2002 | Zemlak et al. | |
| 6,460,462 | B1 | 10/2002 | Rosenstock | |
| 2002/0083860 | A1 | 7/2002 | Shim | |
| 2003/0221829 | A1 | 12/2003 | Patel et al. | |
| 2006/0196693 | A1 | 9/2006 | Bell et al. | |
| 2007/0240880 | A1 | 10/2007 | Olsen | |
| 2009/0159286 | A1 * | 6/2009 | Prouvost et al. | 166/299 |
| 2009/0255661 | A1 | 10/2009 | Clark et al. | |
| 2013/0341029 | A1 * | 12/2013 | Roberts et al. | 166/308.1 |

OTHER PUBLICATIONS

Saharan, M.R., et al. (2006) "Rock fracturing by explosive energy: review of state-of-the-art", *Fragblast: International Journal for Blasting and Fragmentation* vol. 10, 61-81.

PCT/US11/25264 International Search Report and Written Opinion, mailed Apr. 8, 2011.

* cited by examiner

100

200

300

400

500

600

700

1200

SYSTEM AND METHOD FOR FRACTURING ROCK IN TIGHT RESERVOIRS

CROSS-REFERENCE TO RELATED APPLICATION

This application is the National Stage of International Application No. PCT/US2011/025264, filed 17 Feb. 2011, which claims priority benefit of U.S. Provisional Patent Application 61/315,493 filed 19 Mar. 2010 entitled SYSTEM AND METHOD FOR FRACTURING ROCK IN TIGHT RESERVOIRS, the entirety of which is incorporated by reference herein.

FIELD

Exemplary embodiments of the present techniques relate to a system and method for improved fracturing of rock using explosive charges.

BACKGROUND

Low permeability formations are becoming increasingly important hydrocarbon sources. Although these formations may contain substantial volumes of hydrocarbons, the properties of rock in the formations often restrict recovery rates and cumulative volumes to limits that are not commercially viable. For example, tight shale may contain significant amounts of natural gas. However, the low permeability of the shale may impede extraction unless an extensive network of fractures is created in the shale. Techniques for increasing formation permeability have used positive pressure pulses to create fractures in the formation around a potentially productive wellbore.

Explosives were the first method used to create the positive pressure pulses and induce subterranean formation fractures. This was performed by lowering dynamite into the formation, then detonating the dynamite. The method succeeded in creating high-density fracture networks, but the networks had limited spatial extent away from wellbore detonation sites. The method did increase initial recovery rates, but due to the limited spatial extent, the technique did not induce substantial cumulative recovery volumes.

Hydraulic pressure is currently the primary method used for inducing subterranean formation fractures. Surface pumping equipment is used to drive a variety of fluids (gases, foams, gels, water, and oil, among others) down the wellbore and to increase pressure within the formation. When the downhole pressure reaches the sum of the pressure at the fracturing depth with the tensile strength of the rock, fractures form and propagate into the formation as the fluid enters the fractures and causes an associated pressure increase. A variety of solid materials, called proppants, may be pumped into the fractures with the fracturing fluid. These materials help prop the fractures open when the surface pumping equipment is shut down and fluid pressures within the fracture decrease. This method can create fracture networks with significant lateral extent, but with relatively low density. The current practice of hydraulically fracturing a formation addresses the density issue by performing multiple hydraulic fracture treatments along a wellbore. This may result in substantially increased initial recovery rates and cumulative recovery volumes.

The methods for subterranean fracture formation discussed above have several known limitations related to applicability, geometry, sustainability and fluid transfer. Both explosions and hydraulic pressure induce failure by overcoming the compressive earth stress and tensile strength of the rock to create fractures. The fractures often follow the path of least resistance as determined by local stress and can bypass large volumes of the reservoir. These methods work best in brittle materials, such as silica or carbonate cemented formations, but are much less effective in ductile materials, weakly cemented formations or clay mineral-rich formations. The strong dependence on specific geomechanical property values and the local stress directions often reduces the effectiveness of these recovery enhancement options in several classes of potential hydrocarbon resources.

A fracture method should generate a spatially extensive region of pervasive, isotropic permeability increase in the rock of the formation. However, explosions and hydraulic pressure tend to do one or the other. Explosions create instantaneous, high amplitude pressure increases that tend to dissipate rapidly with distance from the detonation site. As a result, this method may create pervasive, isotropic permeability increases, but the effect has a limited spatial extent. Increasing charge size, even up to the use of nuclear devices, tends to increase local damage intensity, rather than significantly extending the spatial distribution. The increase in near wellbore damage may decrease permeability due to deformation phenomena beyond fracture formation.

In hydraulic fracturing, hydraulic pressures can be sustained and transmitted into fractures with sufficient pumping capacity, allowing continuing fracture growth and the ability to develop a fracture zone covering a significant spatial extent. However, the tendency for deformation to focus along a limited number of fractures with a preferred orientation determined by in situ stress conditions, means that this method does not create pervasive, isotropic permeability increases. Modifications to the hydraulic pressure method have been developed and practiced involving multiple treatments, complex pumping sequences, and simultaneous multiple well treatments. These modified methods may improve the pervasiveness and decrease the anisotropy of the resulting permeability increase. They are typically implemented in a brute force manner that does not allow for control of the fracture density or specifying the location of increased density.

Explosions and hydraulic pressure both induce fracture formation through displacement normal to the fracture face as a result of local increases in stress. As the altered in situ stresses relax toward their initial conditions (e.g., fluid from a hydraulic fracture leaks off), the induced fractures will close since the force that held them open is reduced. In the absence of physical displacement (e.g., shear induced offset) or the introduction of rigid materials as proppants, these fractures can close completely with a minimal attendant increase in permeability.

The shattering and physical rotations associated with explosions may act to preserve open fractures. For hydraulic pressure methods, rigid solids, such as sieved sand, are frequently transported by the fracturing fluid and deposited within fractures. These materials are selected to be capable of propping and maintaining open fractures. Empirical evidence suggests that the final propped fracture volume can be substantially less than the initial induced volume. For hydraulic methods, this discrepancy is related to the inability of the fracturing fluid to uniformly distribute propping material within the fracture, while for explosions this is related to the spatial distribution of the deformation mechanisms. In both methods, a significant amount of the work done to create a fracture network is not preserved in the final open fracture network. Even fractures that are propped open at the end of fracturing treatments may close over time. For example, the propping material may be crushed by formation stresses or embedded into the formation. In situ stress conditions and geomechanical properties place a limit on the types of formations and subsurface conditions in which artificially propped fractures are a viable long-term permeability enhancement option.

In addition to the creation of an open, connected fracture network, the potential increase in recovery rate and cumulative volume is influenced by the ability of hydrocarbons to flow from the formation across the fracture face and into the fracture. A fracture method should avoid inhibiting this mass transfer. The fluids used for hydraulically fracturing a formation may have a significant negative impact on hydrocarbon flow across the fracture face. For both oil and gas bearing formations, the use of aqueous fracture fluids can result in imbibition at the fracture face and substantial reductions in the relative permeability for oil and gas. In formations with extremely low initial permeabilities this could create an effective barrier to hydrocarbon flow that would negate the potential increase in flow potential associated with fracture creation.

In the case of gas bearing formations, the use of either oil- or water-based fracture fluids could result in imbibition and reduced gas flow potential. Even in the case where fracture fluids are not imbibed into the fracture face, the presence of higher density fluids in the fractures can decrease the pressure drive for hydrocarbon flow out of the formation (e.g., relative permeability impairment). Again, extremely low initial permeabilities will limit the ability of hydrocarbons to flow out of the formation and flush the fracturing fluids from the fractures. Thus, a more effective use of explosives may allow for increased fracturing and production, without the problems caused by the presence of a fracturing fluid.

The use of explosives can be enhanced by the appropriate placement of explosives in locations in a formation. This can be performed by drilling complex well structures using advanced drilling technologies, such as coiled jet tube drilling, among others. For example, U.S. Pat. No. 5,291,956 describes the use of coiled tubing equipped with a non-rotating jet drilling tool. As another example, U.S. Pat. No. 5,735,350 describes methods and systems for creating a multilateral well and improved multilateral well structures.

Various techniques that use explosives to create extended fracture zones in deep strata exist. For example, U.S. Pat. No. 3,674,089 describes a method for the stimulation of formations using explosives placed in strategically positioned uncompleted wells to fracture a large portion of the formation and create interwell communication. The uncompleted wells can then be plugged, and a completed production well can be drilled into the fracture network to produce oil from the formation. The method was designed for strata with high oil content and porosity, but having a low permeability and, therefore, poor primary production.

U.S. Pat. No. 3,902,422 describes producing a fracture network in deep rock by detonating explosives sequentially in separate cavities. Each detonation occurs after liquid has entered the fracture zones produced by previous adjacent detonations. Thus, each detonation sweeps out fines caused by previous detonations. The fracture network can then be leached to remove ores from the fractured zone.

U.S. Pat. No. 6,460,462 describes a method of blasting rock or similar materials in surface and underground mining operations. In the method described, neighboring boreholes are charged with explosives and primed with detonators. The detonators are programmed with respective delay intervals according to the firing pattern and the mineralogical/geological environment and the resulting seismic velocities.

U.S. Pat. No. 5,295,545 describes placement of a propellant in a well. The propellant is ignited to rapidly produce combustion gases to generate pressure exceeding the fracture extension pressure of the surrounding formation. The combustion gases are generated at a rate greater than can be absorbed into any single fracture, thereby causing propagation of multiple fractures into the surrounding formation.

Techniques exist for placing proppant in fractures using explosives. For example, U.S. Pat. No. 4,714,114 describes the use of a controlled pulse fracturing (CPF) process whereby explosives create fractures and inject proppants into the fracture thereby improving oil production. U.S. Pat. No. 3,713,487 describes a method for explosive fracturing of the petroleum formation adjacent to the well, which is carried out in the presence of a propping agent, such as glass beads, sand or aluminum particles. The propping agent is injected into fractures formed by the explosion and, thus, avoiding the necessity for the use of liquids for fracturing or propping. Following this concept, U.S. Pat. No. 4,391,337 describes an integrated jet perforation and controlled propellant fracture device. The fracturing device is constructed with a cylindrical housing of variable cross-section and wall-thickness with the housing filled with combustible propellant gas generating materials surrounding specially oriented and spaced shaped charges. An abrasive material is distributed within the propellant filled volume along the device length to produce perforations. The device is placed in a formation and ignited, wherein a high velocity jet penetrates the production zone of the wellbore initiating fractures. Ignition of a high pressure propellant material simultaneously follows, which amplifies and propagates the jet initiated fractures. Although these references describe the explosive emplacement of proppants in a formation, none describe the generation of an extensive network of fractures in tight reservoirs.

SUMMARY

An exemplary embodiment of the present techniques provides a system for explosive fracturing of a reservoir. The system may include a squash head charge and a frame configured to orient the squash head charge towards a rock face in a wellbore in the reservoir.

The system may also include an internal electrical bus coupled to the squash head charge, wherein the internal electrical bus is configured to carry an ignition signal to a primer charge to detonate the squash head charge. A controller may be coupled to the internal electrical bus, with a cable connecting the controller through the wellbore to a surface, wherein the cable is configured to carry a signal to the controller to trigger the ignition signal.

In an exemplary embodiment, the system includes a controller coupled to the internal electrical bus and a receiver coupled to the controller, wherein the receiver is configured to detect a signal pulse to trigger the ignition signal from the controller. A portable power source may be coupled to the controller and the pulse detector.

The system may include a propellant charge that propels a proppant into fractures induced in the rock face by an explosion of the squash head charge. The proppant may include sand, glass beads, ceramics particles, or any combinations thereof. In an exemplary embodiment, the proppant includes an energetic material that is configured to detonate in the fractures.

The frame may include a case configured to allow the squash head charge to be conveyed into the wellbore by a fluid flow. The wellbore may be a lateral wellbore drilled out from a main wellbore.

Another exemplary embodiment of the present techniques provides a method of fracturing rock in a reservoir. The method may include drilling one or more wells into the reservoir, wherein at least one of the wells comprises a main wellbore with two or more lateral wellbores drilled out from the main wellbore. A centerline at an end of each lateral wellbore that is opposite the main wellbore may be within a cone of about 30° of perpendicular to the main wellbore. One or more explosive charges may be placed within each of the two or more lateral wellbores. The explosive charges can be detonated to generate pressure pulses that at least partially fracture a rock between the two or more lateral wellbores, where the detonations are timed such that one or more pressure pulses emanating from different lateral wellbores interact.

A plurality of main wellbores branching from at least one of the wells may be drilled. The plurality of main wellbores are substantially parallel to each other, and each of the plurality of main wellbores can be coupled to a plurality of lateral wellbores.

In an exemplary embodiment, a lateral wellbore is drilled from the main wellbore using mechanical bits. In embodiments, a lateral wellbore may be drilled using water jets. The explosive charges may be detonated substantially simultaneously. A proppant may be placed into fractures induced by the pressure pulses using hydraulic fracturing techniques. In an exemplary embodiment, the main wellbore is substantially parallel to a direction of minimum horizontal stress in a rock formation. The main wellbore may be substantially perpendicular to a direction of minimum horizontal stress in a rock formation.

Lateral wellbores can be drilled off a main wellbore such that three or more wellbore branches substantially form a plane. In an exemplary embodiment, the plane may be approximately horizontal. In another embodiment, the plane may be approximately vertical.

The explosive charges can be squash head explosives. The explosive charges can be detonated in a sequence that has been optimized based on computer simulation of the pressure pulses and a strength and a distribution of nodes of maximum constructive interference. In an exemplary embodiment, the explosive charges may be placed in a lateral wellbore by flowing a fluid carrying the charges into the lateral wellbore.

Another exemplary embodiment of the present techniques provides a method of harvesting production fluids from a subsurface rock formation. The method can include drilling a well into the formation, wherein the well comprises a main wellbore. Two or more lateral wellbores may be drilled from the main wellbore, wherein each of the lateral wellbores is substantially perpendicular to the main wellbore. A tool carrying a squash head charge may be placed into each of the lateral wellbores. The squash head charge may be detonated in a timed sequence configured to allow a shock wave from the squash head charge to interact with a second shock wave from the detonation of another squash head charge. Production fluids can be extracted from the subsurface rock formation. In an exemplary embodiment, a propellant charge can be detonated to propel a proppant into fractures created by the detonation of the squash head charge.

DESCRIPTION OF THE DRAWINGS

The advantages of the present techniques are better understood by referring to the following detailed description and the attached drawings, in which.

DETAILED DESCRIPTION

Figure 1:
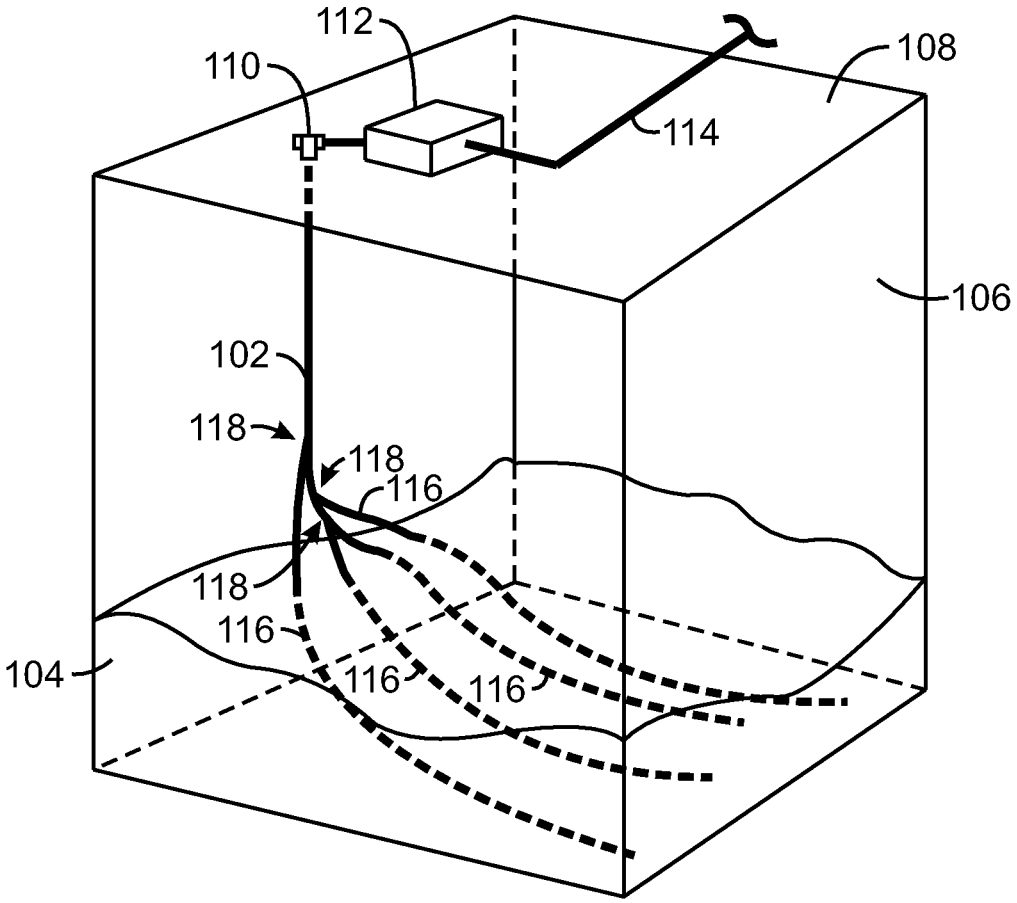
FIG. 1 is a diagram of a reservoir, in accordance with an exemplary embodiment of the present techniques.

In the following detailed description section, specific embodiments of the present techniques are described. However, to the extent that the following description is specific to a particular embodiment or a particular use of the present techniques, this is intended to be for exemplary purposes only and simply provides a description of the exemplary embodiments. Accordingly, the techniques are not limited to the specific embodiments described below, but rather, include all alternatives, modifications, and equivalents falling within the true spirit and scope of the appended claims.

At the outset, for ease of reference, certain terms used in this application and their meanings as used in this context are set forth. To the extent a term used herein is not defined below, it should be given the broadest definition persons in the pertinent art have given that term as reflected in at least one printed publication or issued patent. Further, the present techniques are not limited by the usage of the terms shown below, as all equivalents, synonyms, new developments, and terms or techniques that serve the same or a similar purpose are considered to be within the scope of the present claims.

As used herein, "boundaries" refer to locations of changes in the properties of subsurface rocks, which typically occur between geologic formations. This is relevant, for example, to the thickness of formations.

As used herein, "completion" of a well involves the design, selection, and installation of equipment and materials in or around the wellbore for conveying, pumping, stimulating, or controlling the production or injection of fluids. After the well has been completed, production of the formation fluids can begin.

As used herein, "completion activities" may include, but is not limited to, cementing (such as cementing the casing in place for zonal isolation and well integrity), perforating the wellbore, stimulation (including but not limited to matrix acidizing, fracture acidizing, hydraulic fracturing, and explosive fracturing), drilling horizontal wellbores, drilling lateral wellbores, and jetting. Further completion activities include installation of production equipment into the wellbore, as well as sand management and water management. Completion activities may include the explosive fracturing techniques discussed herein.

As used herein, "coil tubing jet drilling" is a technique for well construction that involves using a continuous non-rotating string of pipe and a rotating drill head or hydraulic jets to create holes in a rock formation.

As used herein, "directional drilling" is the intentional deviation of the wellbore from the path it would naturally take. In other words, directional drilling is the steering of the drill string so that it travels in a desired direction.

As used herein, "exemplary" is used exclusively herein to mean "serving as an example, instance, or illustration." Any embodiment described herein as "exemplary" is not to be construed as preferred or advantageous over other embodiments.

As used herein, "facility" refers to a tangible piece of physical equipment through which hydrocarbon fluids are either produced from a reservoir or injected into a reservoir, or equipment which can be used to control production or completion operations. In its broadest sense, the term facility is applied to any equipment that may be present along the flow path between a reservoir and its delivery outlets, which are the locations at which hydrocarbon fluids either leave the model (produced fluids) or enter the model (injected fluids). Facilities may comprise production wells, injection wells, well tubulars, wellhead equipment, gathering lines, manifolds, pumps, compressors, separators, surface flow lines and delivery outlets. In some instances, the term "surface facility" is used to distinguish those facilities other than wells. A "facility network" is the complete collection of facilities that are present in the model, which would include all wells and the surface facilities between the wellheads and the delivery outlets.

As used herein, a "formation" is any finite subsurface region. The formation may contain one or more rock layers comprising hydrocarbons, an overburden, or an underburden. An "overburden" or an "underburden" is geological material above or below the formation of interest. For example, overburden or underburden may include rock, shale, mudstone, or other types of sedimentary, igneous or metamorphic rocks. A formation also includes hot dry rock layers useful for the production of geothermal energy.

As used herein, a "fracture" is a crack or surface of breakage within rock not related to foliation or cleavage in metamorphic rock along which there has been minimal movement. A fracture along which there has been lateral displacement may be termed a fault. When walls of a fracture have moved only normal to each other, the fracture may be termed a joint. Fractures may enhance permeability of rocks greatly by connecting pores together, and for that reason, joints and faults may be induced mechanically in some reservoirs in order to increase fluid flow.

As used herein, "lithostatic pressure" (sometimes referred to as "lithostatic stress") is a pressure in a formation equal to a weight per unit area of an overlying rock mass (the "overburden"). The vertical formation stress increase may be around 1 psi for every foot of depth. Thus, a formation that is 100 feet deep may have a fluid pressure up to 100 psig before mechanical failure associated with lifting of the overlying formation occurs.

As used herein, "geological layers", or "layers", refers to layers of the subsurface (for example, the Earth's subsurface) that are disposed between geologic formation tops. A geological layer may include a hot dry rock formation or may represent subsurface layers over a hot dry rock layer.

As used herein, a "hot dry rock" layer is a layer of rock that has a substantial temperature differential with the surface, for example, 50° C., 100° C., or even greater. The hot dry rock layer may be a granite basement rock around two to 20 Km, or even greater, below the surface of the Earth. The heat in a hot dry rock layer may be harvested for energy production. Despite the name, "hot dry rock" is not necessarily devoid of water. Rather, such layers of rock will not naturally produce significant amounts of water or steam flows to the surface without the aid of pumps or fluid injection.

As used herein, a "horizontal wellbore" refers to the portion of a wellbore in an subterranean zone to be completed which is substantially horizontal or at an angle from horizontal in the range of from about 0° to about 15°.

As used herein, "hydraulic fracturing" is used to create or open fractures that extend from the wellbore into formations. A fracturing fluid, typically viscous, can be injected into the formation with sufficient hydraulic pressure (for example, at a pressure greater than the lithostatic pressure of the formation) to create and extend fractures, open pre-existing natural fractures, or cause slippage of faults. In the formations discussed herein, natural fractures and faults can be opened by the pressure. A proppant may be used to "prop" or hold open the fractures after the hydraulic pressure has been released. The fractures may be useful for allowing fluid flow, for example, through a tight shale formation, or a geothermal energy source, such as a hot dry rock layer, among others.

As used herein, "imbibition" refers to the incorporation of a fracturing fluid into a fracture face by capillary action. Imbibition may result in decreases in permeation of a formation fluid across the fracture face. For example, if the fracturing fluid is an aqueous fluid, imbibition may result in lower transport of hydrocarbons across the fracture face, resulting in decreased recovery. The decrease in hydrocarbon transport may outweigh any increases in fracture surface area resulting in no net increase in recovery, or even a decrease in recovery, after fracturing.

As used herein, a "lateral wellbore" refers to a well segment drilled out from a main wellbore into a formation. The lateral wellbore is uncased and, thus, any item inserted into the lateral wellbore is potentially in direct contact with the rock of a formation.

As used herein, "overburden" refers to the sediments or earth materials overlying the formation containing one or more hydrocarbon-bearing zones. The term "overburden stress" refers to the load per unit area or stress overlying an area or point of interest in the subsurface from the weight of the overlying sediments and fluids. The "overburden stress" is the load per unit area or stress overlying the hydrocarbon-bearing zone that is being conditioned and/or produced according to the embodiments described. The pressure is discussed in detail with respect to lithostatic pressure, above.

As used herein, "permeability" refers to the capacity of a rock to transmit fluids through the interconnected pore spaces of the rock; the customary unit of measurement is the millidarcy. The term "relatively permeable" is defined, with respect to formations or portions thereof, as an average permeability of 10 millidarcy or more (for example, 10 or 100 millidarcy). The term "relatively low permeability" is defined, with respect to formations or portions thereof, as an average permeability of less than about 10 millidarcy.

As used herein, "pressure" and "total pressure" are interchangeable and have the usual meaning wherein the pressure in an enclosed volume is the force exerted per unit area by the gas on the walls of the volume. Pressure can be shown as pounds per square inch (psi). "Atmospheric pressure" refers to the local pressure of the air. Local atmospheric pressure is assumed to be 14.7 psia, the standard atmospheric pressure at sea level. "Absolute pressure" (psia) refers to the sum of the atmospheric pressure plus the gauge pressure (psig). "Gauge pressure" (psig) refers to the pressure measured by a gauge, which indicates only the pressure exceeding the local atmospheric pressure (i.e., a gauge pressure of 0 psig corresponds to an absolute pressure of 14.7 psia).

As used herein, "production fluids" include any material that is harvested from a reservoir or subsurface rock formation. Production fluids may include hydrocarbons, such as oil or gas, harvested from a hydrocarbon formation. Production fluids may also include hot fluids, such as steam or water, harvested from a hot dry rock formation.

As used herein, a "reservoir" refers to a subsurface rock formation from which a production fluid can be harvested. The rock formation may include granite, silica, carbonates, clays, and organic matter, such as oil, gas, or coal, among others. Reservoirs can vary in thickness from less than one foot (0.3048 m) to hundreds of feet (hundreds of m). The permeability of the reservoir provides the potential for production. As used herein a reservoir may also include a hot dry rock layer used for geothermal energy production.

As used herein, "stimulation operations" refer to activities conducted on wells in formations to increase a production rate or capacity (for example, of hydrocarbons) from the formation, among other things. Stimulation operations also may be conducted in injection wells. One example of a stimulation operation is a fracturing operation, which generally involves injecting a fracturing fluid through the wellbore into a subterranean formation at a rate and pressure sufficient to create or enhance at least one fracture therein, thereby producing or augmenting productive channels through the formation. The fracturing fluid may introduce proppants into these channels. Other examples of stimulation operations include, but are not limited to, explosive fracturing, acoustic stimulation, acid squeeze operations, fracture acidizing operations, and chemical squeeze operations. In an explosive fracturing stimulation operation, an explosive or propellant compound is placed in the formation and ignited. The explosive compound fractures the formation through the generation of a shock wave from the explosion. A propellant compound stimulates the formation be generating a large volume of very high pressure gas.

As used herein, "substantial" when used in reference to a quantity or amount of a material, or a specific characteristic thereof, refers to an amount that is sufficient to provide an effect that the material or characteristic was intended to provide. The exact degree of deviation allowable may in some cases depend on the specific context. Similarly, "substantially free of" or the like refers to the lack of an identified element or agent in a composition. Particularly, elements that are identified as being "substantially free of" are either completely absent from the composition, or are included only in amounts which are small enough so as to have no measurable effect on the composition.

As used herein, "thickness" of a layer refers to the distance between the upper and lower boundaries of a cross section of a layer, wherein the distance is measured normal to the average tilt of the cross section.

As used herein, a "well" refers to a hole to a subsurface formation generally used for producing fluids or gases from the formation. A well can include a single wellbore, or can have multiple wellbores that branch off. As used herein, a multilateral well is a well that has numerous lateral wellbores drilled out from one or more main wellbores. A well may be of any type, including, but not limited to a producing well, an experimental well, an exploratory well, or the like.

As used herein, a "wellbore" refers to a hole in the subsurface made by drilling or insertion of a conduit into the subsurface. A wellbore may makeup part, or all, of a well. A wellbore may have a substantially circular cross section, or other cross-sectional shapes (for example, circles, ovals, squares, rectangles, triangles, slits, or other regular or irregular shapes). Wellbores may be cased, cased and cemented, or open-hole wellbore. A wellbore may be vertical, horizontal, or any angle between vertical and horizontal (a deviated wellbore), for example a vertical wellbore may comprise a non-vertical component.

As used herein, "wellhead" refers to the pieces of equipment mounted at the opening of a well, for example, to regulate and monitor the production fluids from the underground formation. It also prevents leaking of production fluids out of the well, and prevents blowouts due to high pressures fluids formations. Formations that generate high temperature fluids, such as superheated water or steam, that are under high pressure typically require wellheads that can withstand a great deal of upward pressure from the escaping gases and liquids. These wellheads may often be designed to withstand pressures of up to 20,000 psi (pounds per square inch). The wellhead consists of three components: the casing head, the tubing head, and the 'Christmas tree'. The casing head consists of heavy fittings that provide a seal between the casing and the surface. The casing head also serves to support the casing that is run down the wellbore. This piece of equipment typically contains a gripping mechanism that ensures a tight seal between the head and the casing itself.

Overview

An exemplary embodiment of the present techniques provides a method to enhance hydrocarbon production from subterranean formations using explosives. The explosives are strategically placed in a number of lateral wellbores drilled out from one or more main wellbores, so that the explosive effects are amplified and reinforced between the lateral wellbores, thereby fracturing a large rock volume. The lateral wellbores can be drilled out from the main wellbore by various techniques, such as coiled tube jet drilling. The explosives can be in the form of explosive charges based on high explosive squash head (HESH) military ordnance. Squash head charges may focus more of the energy from a detonation into the reservoir rock, leading to greater fracturing.

The squash head charges may also be configured to explosively convey proppants into the fractures formed by the detonation, reducing or even eliminating the use of hydraulic fluids. The reduction of hydraulic fluids may decrease the possibility of permeability reduction due to fluid imbibition. However, the techniques are not limited to the elimination of hydraulic fracturing, as the explosive fracturing can be combined with a secondary hydraulic fracturing to further fracture the rock and transport proppant into the fractures. The techniques may be useful for opening low permeability gas-bearing formations (e.g., tight sands, shales) that require stimulation.

FIG. 1 is a diagram of a reservoir, in accordance with an exemplary embodiment of the present techniques. The diagram 100 shows a well 102 that is drilled down to a reservoir 104 through an overburden 106. At the surface 108, a wellhead 110 can be connected to a facility 112 for processing produced fluids, for example, drying and compressing a natural gas prior to shipping the gas through a pipeline 114. The present techniques are not limited to a single well 102 or to hydrocarbon production as they may be used in other configurations and applications.

For example, in an exemplary embodiment, the explosive fracturing techniques disclosed herein may be used for enhancing production of geothermally heated fluids from a hot rock layer. In geothermal energy production, multiple wells can be used, with a portion of the wells injecting fluid for heating by the formation, and a portion of the wells harvesting the geothermally heated fluids. According, a dense fracture network between the injection and productions well may improve the efficiency and increase the lifespan of the reservoir.

The well 102 can have multiple main wellbores 116 that branch off from the well 102 to drain other portions of the reservoir 104. Generally, if hydraulic fracturing is to be used, multiple branches increase the cost of completing a well 102, due to the cost of the fittings used at branch points 118. For example, the fittings must have sufficient strength to withstand the pressure used for creating fracture networks in rock by hydraulic fracturing. Thus, if hydraulic fracturing is to be used, it may be more economical to drill a number of individual wells that have no branching than to place the high pressure fittings in a branched well. Accordingly, techniques for creating dense fracture networks, as described herein, may allow for drilling multiple main wellbores 116 from a single well 102 without the need for costly junctions and, thus, allowing for depletion of a greater portion of a reservoir with a single well.

Sequenced Detonation in Multiple Lateral Wellbores

Figure 2:
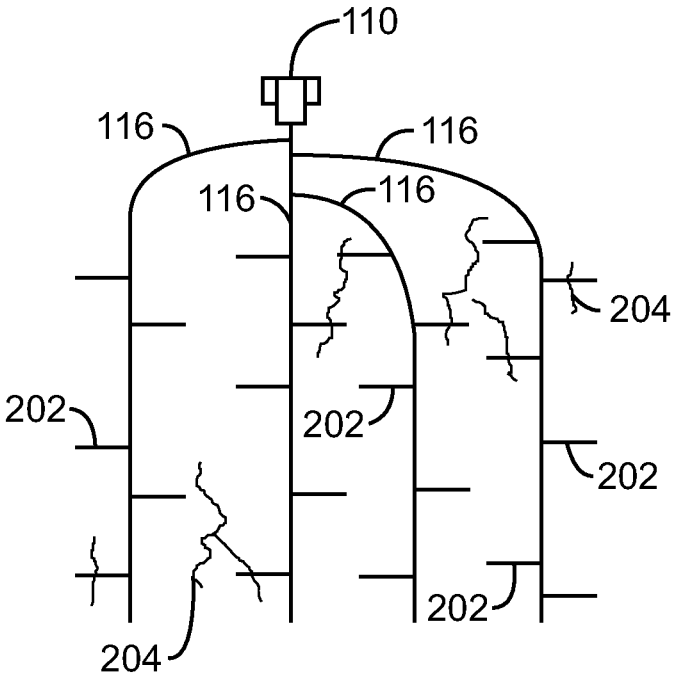
FIG. 2 is a top view of the reservoir, showing multiple lateral wellbores drilled off from each adjacent segment of a main wellbore, in accordance with an exemplary embodiment of the present techniques.

FIG. 2 is a top view of the reservoir, showing multiple lateral wellbores drilled off from each adjacent segment of a main wellbore, in accordance with an exemplary embodiment of the present techniques. The top view 200 illustrates numerous lateral wellbores 202 that may be drilled from each of the main wellbores 116. The lateral wellbores 202 may be placed in a parallel array or staggered at different angles. Further, the lateral wellbores 202 can be vertical to the main wellbores 116. In other embodiments, the main wellbores 116 may be vertical, and the lateral wellbores 202 drilled out at in a substantially horizontal attitude. An arrangement of the main wellbores 116 and lateral wellbores 202 for a particular reservoir can be determined through advanced geomechanical modeling or experiments. In exemplary embodiments of the present techniques, the lateral wellbores 202 are substantially perpendicular to the main wellbores 116, after any curves made when drilling out from the main wellbore 116. In other words, a centerline of a lateral wellbore 202 at the opposite end of the lateral wellbore 202 from the main wellbore 116 can be substantially perpendicular to the main wellbore 116. In an exemplary embodiment of the present techniques, substantially perpendicular indicates that the centerline of the lateral wellbore 202, at the end of the lateral wellbore 202 opposite the main wellbore 116, is within a cone of about 30° around a perpendicular line drawn out from the main wellbore 116. Closer to the main wellbore 116, the lateral wellbore 202 may be at a lower angle, depending on the drilling techniques used to create the lateral wellbore 202.

The drilling of the lateral wellbores 202 may be performed using any number of techniques that can drill outward from the main wellbores 116, including, for example, coil tubing jet drilling or mechanical drilling. After the lateral wellbores 202 are drilled out from the main wellbores 116, explosives may be placed into the lateral wellbores 202. After the explosives are in place, they can be detonated simultaneously or in a proscribed sequence that is optimized for the local geology. The simultaneous or sequenced detonation may create a dense network of fractures 204 between the lateral wellbores 202. Fractures 204 that connect to a lateral wellbore 202 or across multiple lateral wellbores 202 may allow hydrocarbons (or other produced fluids) to flow to the lateral wellbores 202 and into the main wellbores 116 for production at the well head 110.

Figure 3:
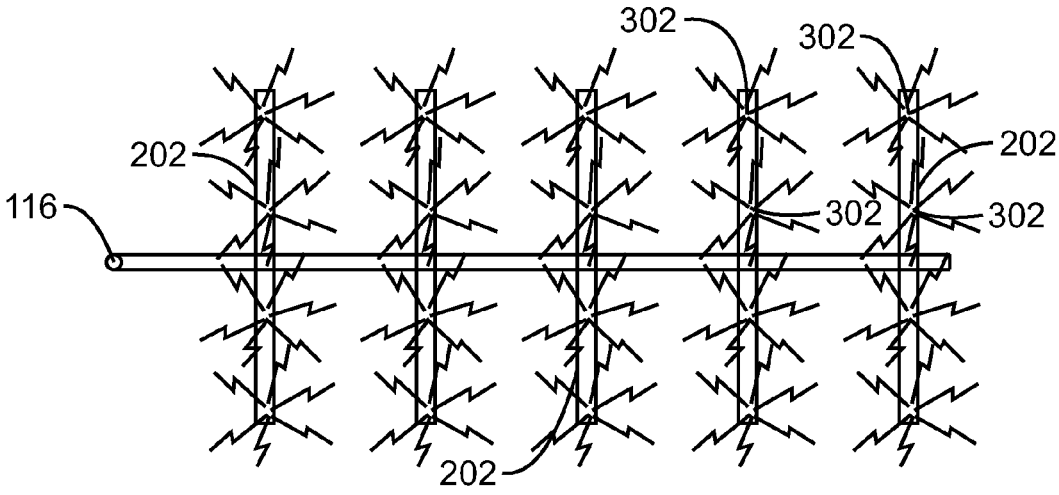
FIG. 3 is a top view of one main wellbore with a number of lateral wellbores, showing a sequenced detonation of explosives in the lateral wellbores, in accordance with an exemplary embodiment of the present techniques.

FIG. 3 is a top view 300 of one main wellbore 116 with a number of lateral wellbores 202, showing a sequenced detonation of explosives in the lateral wellbores 202, in accordance with an exemplary embodiment of the present techniques. In this view 300, a number of lateral wellbores 202 extend from the main wellbore 116, each of which has two explosive charges 302. As shown in this view 300 all of the explosives can be simultaneously detonated. However, the techniques are not limited to this configuration, as any number of other configurations may be identified by modeling or experiments. For example, although two explosive charges per lateral are shown, any number of charges may be used. In some embodiments, there may be five, ten, twenty, fifty, or more explosive charges in each lateral. As discussed further with respect to FIG. 4, the simultaneous detonation may cause constructive and destructive interference of pressure waves. The interference of the pressure waves may increase the effectiveness of the charges for the fracturing of rock over detonating individual charges in each of the lateral wellbores 202.

Figure 4:
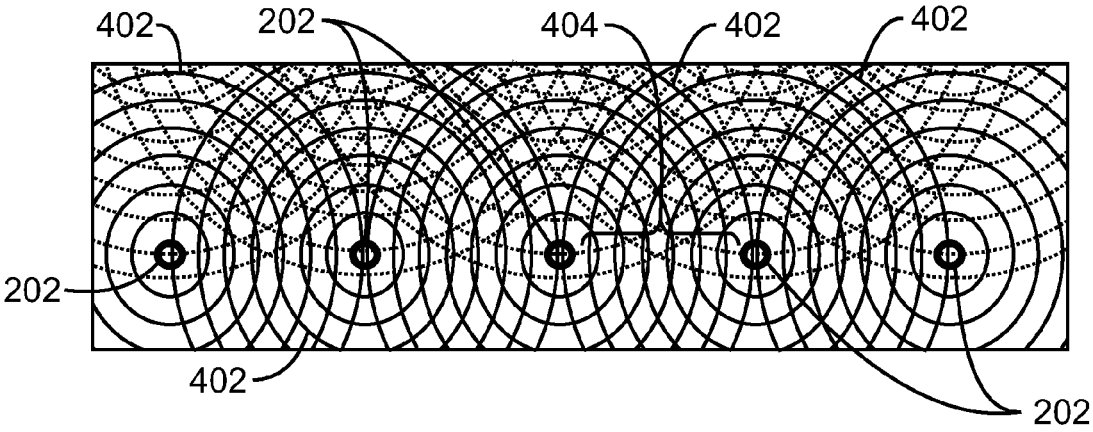
FIG. 4 is a side view of FIG. 3, showing multiple shock waves emanating from the detonations in the lateral wellbores, in accordance with an exemplary embodiment of the present techniques.

FIG. 4 is a side view 400 of FIG. 3, showing multiple shock waves 402 emanating from the detonations in the lateral wellbores 202, in accordance with an exemplary embodiment of the present techniques. The shock waves 402 may have cumulative effects at intersect points 404 (for example, between the lateral wellbores 202), due to the constructive and destructive interference. Accordingly, the multiple shock waves 402 may promote fracturing at a greater distance from a lateral wellbore 202 than an individual explosion within a single lateral wellbore 202.

As an example, using a dynamite charge at a single point in a wellbore, a 10 cm diameter borehole can generate fractures ~5 meter out from the detonation. As discussed below with respect to FIGS. 6-9, a squash head explosive may generate greater fracture distances, due to the focusing of the blast energy outward from a lateral wellbore 202. The detonation of a squash head explosive may generate fractures >~30 meters out from the detonation. The use of simultaneously or timed detonations between lateral wellbores 202 may increase the effective fracture zone as shock fronts wave from individual lateral wellbores 202 reinforce each other. For example, the interference of the shock waves 402 may extend the fracture zone created by the detonation of squash head explosives to >~50 meters from each lateral wellbore 202.

Figure 5:
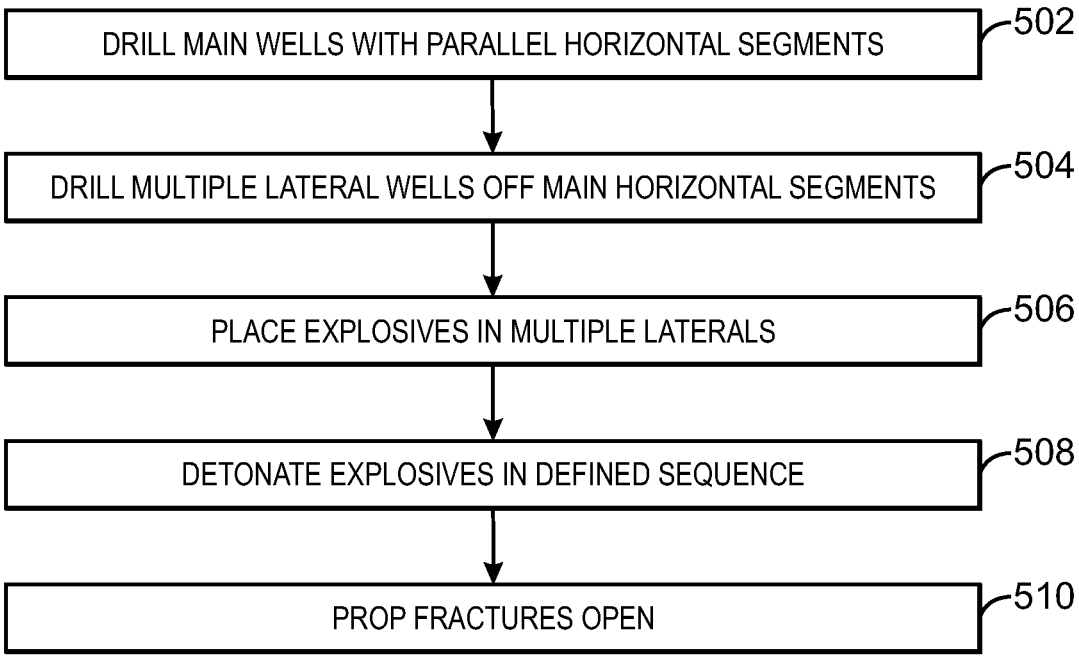
FIG. 5 is a method of fracturing rock in a reservoir, in accordance with an exemplary embodiment of the present techniques.

FIG. 5 is a method 500 of fracturing rock in a reservoir, in accordance with an exemplary embodiment of the present techniques. The method begins at block 502 with the drilling of at least one main wellbore. In an exemplary embodiment, the main wellbore includes a number of adjacent wellbores that branch off the main wellbore, for example, to form horizontal sections. At block 504, multiple lateral wellbores are drilled off a main wellbore, for example, using coiled tubing jet drilling. At block 506, explosive shells are placed within the lateral wellbores. The explosives can be configured as squash head explosives to increase the energy conveyed into the rock layers, as discussed herein. At block 508, all of the explosives within the lateral wellbores can be detonated simultaneously or the explosives can be detonated in a defined sequence to establish reinforcing shock waves, creating fractures in the rock. At block 510, proppant can be carried into the factures by the high velocity gases formed during the detonation of a propellant charge into the fractures created by the detonations.

Squash Head Explosives

The detonation of explosives in a wellbore transfers a large amount of energy in a short duration impulse. The short duration of the impulse tends to dominate the initiation of cracks in the borehole wall, which may override the influences of the residual tectonic stresses in the formation. In other words, fractures may radiate from the detonation point in random directions rather than having a primary fracture direction controlled by the in situ stresses, as may occur in hydraulic fracturing.

However, using large conventional or shaped charge explosives may overstress the strata in the immediate borehole wall, forming a substantial amount of rubble. The consequence is that excessive energy is expended near the wellbore without useful results. The resulting fractures do not extend deeply into the formation surrounding the borehole. Adaptation of the high explosive squash-head type military ordnance to rock fracturing may mitigate this disadvantage.

Figure 6:
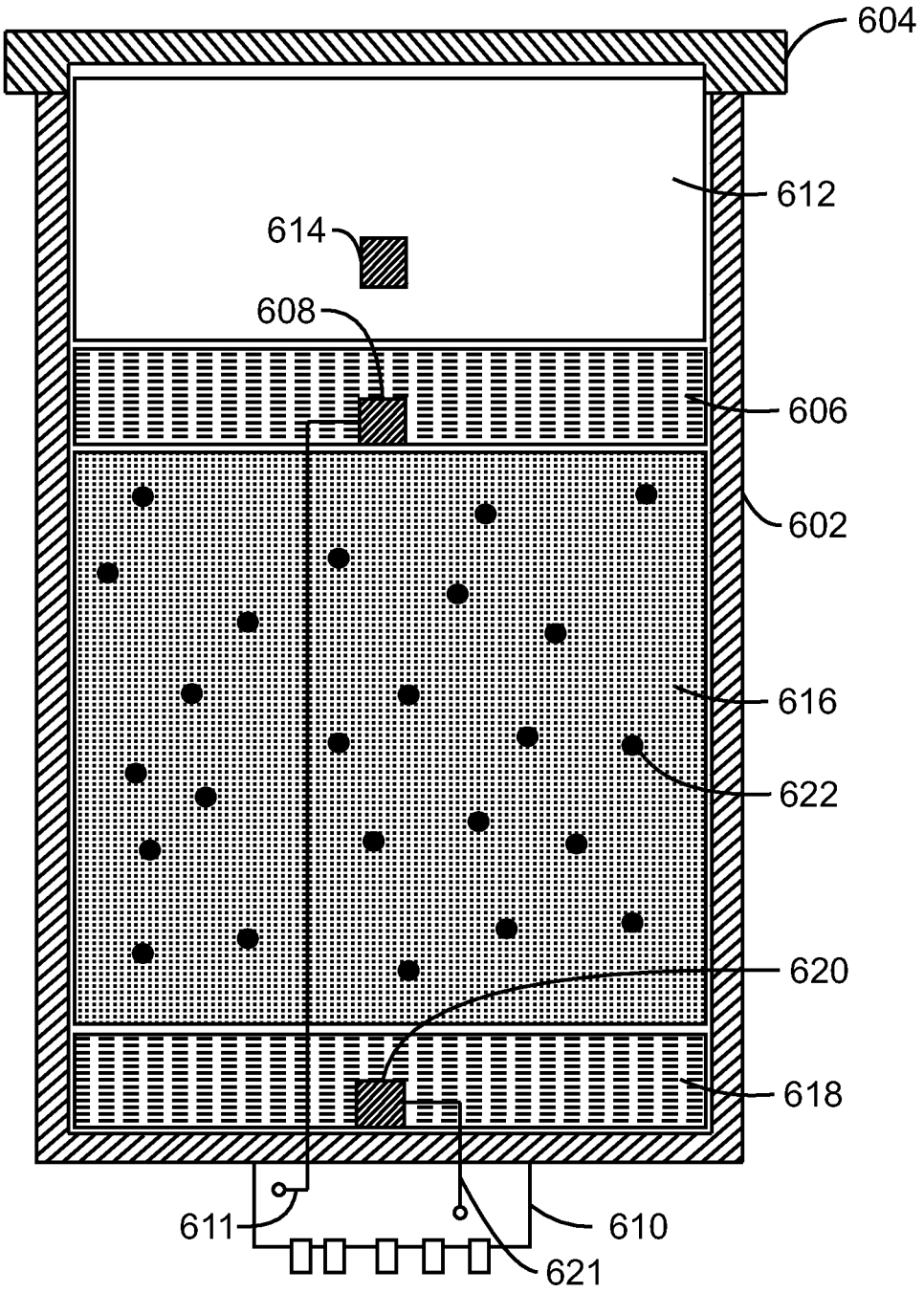
FIG. 6 is a schematic view of an adapted squash head explosive that may be used in exemplary embodiments of the present techniques.

FIG. 6 is a schematic view of an adapted squash head explosive 600 that may be used in exemplary embodiments of the present techniques. The squash head explosive 600 can be assembled in a canister 602. The canister 602 can be constructed from a material with sufficient strength to confine and direct the explosion into a rock formation, such as steel, other metals, or high performance plastics, such as polyphenylene sulfide (PPS). The canister 602 can have a lid 604 to hold the contents in place and protect them from damage during placement. The lid 604 does not have to be the same material as the canister 602, but can be a weaker material, such as a polyethylene or other plastic, a thin metal layer, or other suitable materials, to allow for a low energy rupture upon detonation of a propelling charge 606.

During detonation, the propelling charge 606 is ignited by an electrically triggered primer 608 that is electrically coupled to a detonator 610, for example, by an electrical line 611. The electrical line 611 can be connected to one detonation circuit within the detonator 610, while other charges (such as a propellant charge) can be connected to other detonation circuits. The detonation of the propelling charge 606 propels a mass of plastic explosive 612 at a low velocity (about 200 to 400 feet/sec). The plastic explosive 612 is propelled through the lid 604, deforming into a disk against a surface of a rock formation, for example, within a lateral wellbore. A primer 614 that is embedded in the plastic explosive 612 is ignited by the shock wave as the plastic explosive 612 is flattened, or squashed, against the rock formation, triggering the detonation of the plastic explosive 612. Because of the large surface area of the flattened plastic explosive 612 and the direct contact with the rock formation, high intensity shock waves are effectively conducted into the rock formation.

The fractures generated from reservoir rock stimulation may close if not propped open. The shattering and physical rotation of rock in the rock formation caused by the explosions may act to prop open fractures. However, the fractures may be more efficiently propped open by the injection of rigid solids such as those used in hydraulic fracturing. The adapted squash head explosive 600 can have a packet of proppant 616 and a secondary explosive 618 located behind the propelling charge 606. After the detonation of the plastic explosive 612, the secondary charge 618 can be triggered by a secondary igniter 620, for example, by a propellant detonation line 621, to explosively drive the proppant 616 into the fractures formed by the shock waves from the squash head detonation. The propellant detonation line 621 can be connected to a different detonation circuit than the electrical line 611. The proppant 616 can be any inert material that has sufficient strength to withstand formation pressures without being crushed, such as sand, glass beads, ceramic particles, or any number of other materials.

Further, the proppant 616 may include a high-energy material 622 to induce further fracturing. The high energy material 622 may be triggered, for example, by a timed burning fuse ignited by the secondary charge 618. The use of a proppant 616 that contains an energetic material 622 that is configured to explode after embedment may further fracture the reservoir rock. The energetic material 622 may not invade far into the fractures, but may provide structural voids near the wellbore delaying the closing of fractures.

Energy Transfer from Sheets of Explosives

As discussed above, squash head explosives are designed to flatten a charge of plastic explosives against a target, such as a rock wall in a formation. For this reason, squash head explosives impart the Misznay-Schardin, or platter, effect. While the blast from a conventional rounded explosive charge generally expands in all directions, the platter effect causes the explosive blast from a sheet of explosive to expand away from (or perpendicular to) the surface of the explosive. If one side is backed by a heavy or fixed object, such as the canister 602, the force of the blast (that is, most of the rapidly expanding gas and the associated kinetic energy) will be directed away from it and into the rock formation. By causing a plastic explosive to pancake on to the rock wall surface before detonation, a larger proportion of the total explosive energy, in comparison to a conventional explosion, is converted into shock waves that propagate away from wellbore. The shock-waves generated along the length of the lateral wellbores will intercept and reinforce each other creating a fracture network that encompasses a large target rock volume.

Flat explosive charges may produce a higher seismic efficiency in formations than conventional charges, creating more complex and structured fracture zones in rock. See Adushkin, V., Budkov, A., and Kocharyan, G., "Features of forming an explosive fracture zone in a hard rock mass," Journal of Mining Science 43, 273-283 (2007); see also Saharan, M. R., Mitri, H. S., Jethwa, J. L., "Rock fracturing by explosive energy: review of state-of-the-art," Fragblast: International Journal for Blasting and Fragmentation 10, 61-81 (2006). This may be further understood by comparisons of graphs of the energy distribution from the detonation of conventional and flat charge explosives in hard and soft rock.

Figure 7:
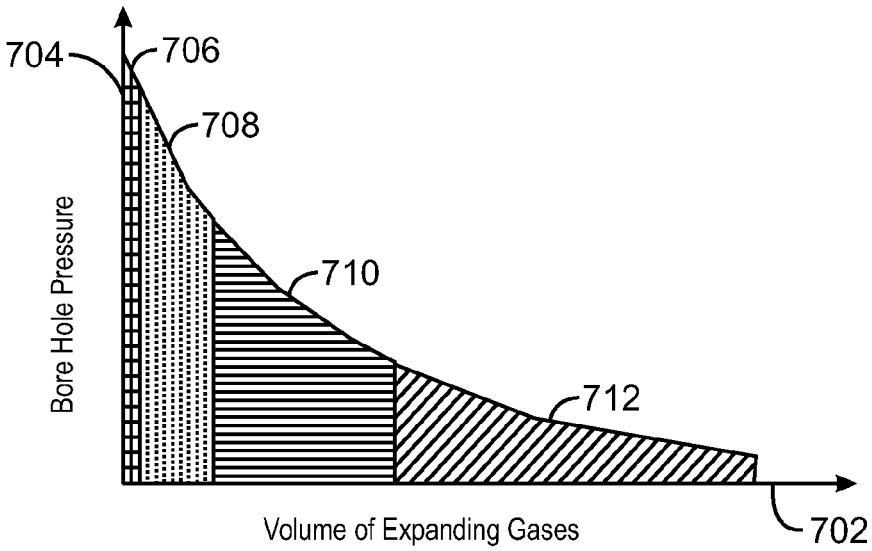
FIG. 7 is a graph showing the energy distribution from an explosion in a wellbore.

FIG. 7 is a graph 700 showing the energy distribution from an explosion in a wellbore. In the graph 700, the x-axis 702 represents the volume of expanding gases, which can be considered as a proxy of the energy from the detonation. The y-axis 704 represents the borehole pressure, which will increase as the depth of the wellbore increases. In any explosion, only a fraction of the energy is available to fracture the rock. For example, as shown in the graph 700, the shock wave energy for driving detonation 706 may be less than about 5% of the total energy. By comparison, the shock wave energy for fracture generation 708 may be less than about 25% of the total energy and the shock wave energy for fracture propagation 710 may be less than about 40% of the total. Thus, in a conventional explosion, 40 to 60% of the chemical energy is wasted as noise, heat, light, and other energy, as indicated by reference number 712. However, even less energy is available as the pressure increases in a formation or as the rock decreases in hardness or the formation pressure increases.

Figure 8A:
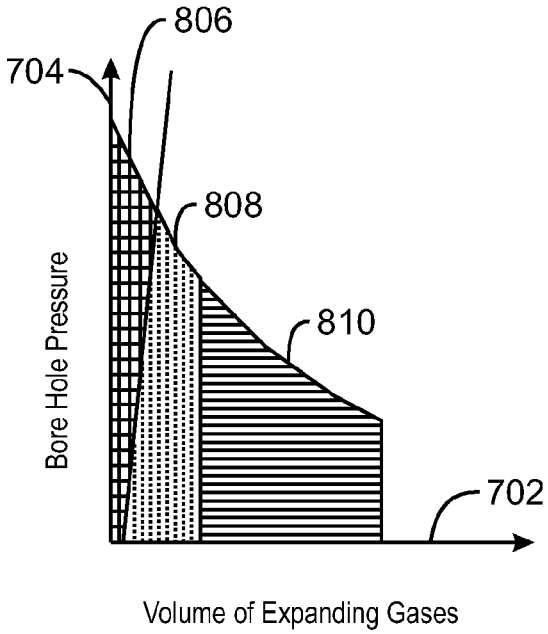
FIG. 8A is a graph of the energy distribution of a detonation of a convention explosive in a hard rock layer.
Figure 8B:
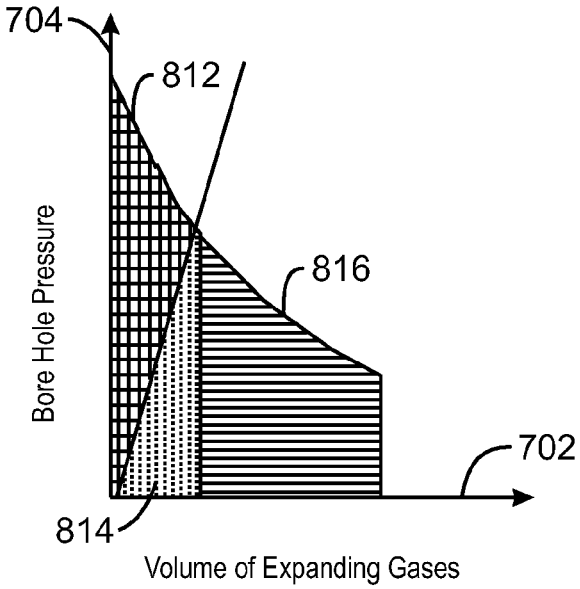
FIG. 8B is a graph of the energy distribution of a detonation of a convention explosive in a soft rock layer.

FIG. 8A is a graph of the energy distribution of a detonation of a convention explosive in a hard rock layer. As shown in FIG. 8A, as the borehole pressure 704 increases in the formation, more energy 806 may be expended in driving the detonation. This leaves less energy available for generating fractures 808 and for propagating the fractures 810. This may be a result of the higher formation pressure, which compress the gases released from an explosion, resulting in less gas for energy transfer to the rock. The effectiveness of explosions in the fracturing of rock is diminished in softer rock. FIG. 8B is a graph of the energy distribution of a detonation of a convention explosive in a soft rock layer. As shown in FIG. 8B, in soft rock the energy expended in driving the detonation 812 may be further increased over hard rock, due to the dissipation of energy by deformation of the soft rock. Thus, less energy may be available for generating fractures 814 and for propagating fractures 816.

Figure 9:
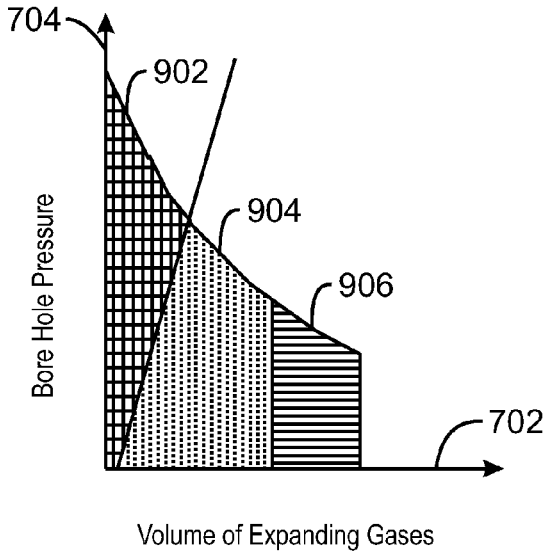
FIG. 9 is a graph of the energy distribution of a flat layer of explosive in a soft rock layer.

FIG. 9 is a graph of the energy distribution of a flat layer of explosive in a soft rock layer. Although the amount of energy expended in driving the detonation 902 may be similar to that expended during the detonation of conventional explosives 812 (FIG. 8B), a larger amount of energy may be expended in generating fractures 904 in the rock formation. Somewhat less energy is expending in propagating fractures 906 than for the detonation of conventional explosives in soft rock 816. Thus, a platter explosion may be more effective than a conventional explosive charge in fracturing a soft rock layer. Accordingly, the use of squash head explosives to deliver charges in the well configuration discussed with respect to FIGS. 1-3 may create a greater number of fractures that are interconnected between the multiple lateral wellbores extending from a main wellbore. In an exemplary embodiment of the present techniques, ductile shales that would respond poorly to conventional explosives can be stimulated for hydrocarbon production.

Well Completion Tools That May Contain Squash Head Charges

To be effective, the squash head explosives should be delivered into the lateral wellbores with the portion containing the plastic explosive facing the surface of the rock formation. Numerous systems may be used in exemplary embodiments of the present techniques, two of which are discussed below with respect to FIGS. 10-12. The delivery systems that may be used are not limited to these systems, as one of skill in the art could identify any number of other systems and configurations that could be used.

Figure 10:
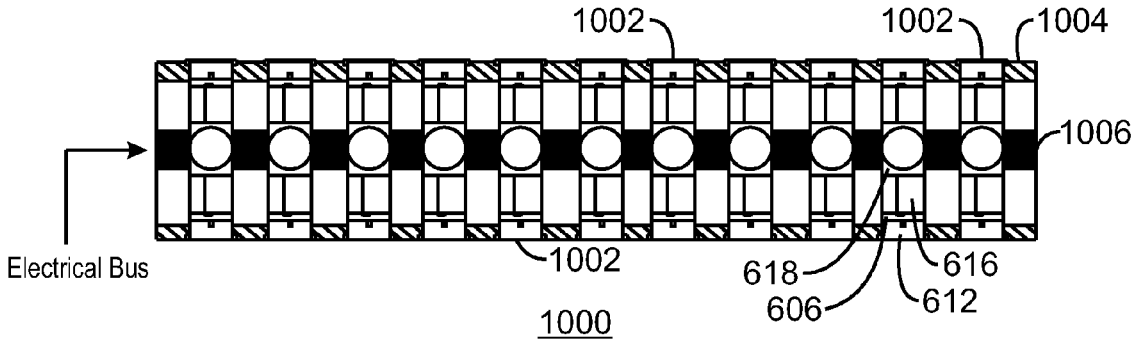
FIG. 10 is a drawing of a tool that holds a number of squash head charges for insertion into a lateral wellbore, in accordance with an exemplary embodiment of the present techniques.

FIG. 10 is a drawing of a tool 1000 that holds a number of squash head charges 1002 for insertion into a lateral wellbore, in accordance with an exemplary embodiment of the present techniques. In an exemplary embodiment, at least some of the squash head charges 1002 have the configuration discussed with respect to FIG. 6. In other embodiments, some or all of the charges may eliminate the proppant 616 and secondary charge 618.

The tool 1000 may have a frame 1004 that generally holds the squash head charges 1002 in alignment, facing each squash head charge 1002 towards the rock face when inserted into a wellbore. The frame 1004 may be made from a flexible material, such as rubber or plastic, to allow the tool 1000 to be inserted into tight spaces. In other embodiments, the frame 1004 may be made from metal and may be articulated at various points along the tool 1000, such as between every group of charges, every other group of charges, at the half way point, or at any other points that may be useful for inserting the tool 1000 into a lateral wellbore. This may be useful if the tool 1000 contains numerous squash head charges 1002, such as 10 groups of four squash head charges 1002, 20 groups of four squash head charges 1002, or more. In other embodiments, the frame may be rigid, for example, if the tool 1000 contains fewer squash head charges 1002, such as seven groups of four, five groups of four, or two groups of four squash head charges 1002. The number of squash head charges 1002 in the tool 1000, or in each group, is not limited to these examples, as any number may be chosen, depending on the characteristics of the formation as determined by modeling and data. The shells may be pointed in multiple directions. In the exemplary tool 1000 shown in FIG. 10, the squash head charges 1002 are pointed at 90° intervals. However, any number of other orientations for the individual squash head charges 1002 may be used depending on the formation and wellbore configurations. An electrical bus 1006 may run down the center of the tool 1000 to ignite the squash head explosives 1002, as discussed further with respect to FIG. 11.

Figure 11:
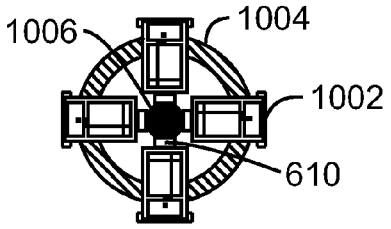
FIG. 11 is a front view of the tool of FIG. 10, in accordance with an exemplary embodiment of the present techniques.

FIG. 11 is a front view of the tool 1000 of FIG. 10, in accordance with an exemplary embodiment of the present techniques. The detonator 610 (FIG. 6) of each squash head charge 1002 may be coupled to the electrical bus 1006 that runs the length of the tool's interior. The electric bus 1006 can be connected to controls on the surface, for example, by a cable running back up the wellbore. In other embodiments, the cable to the surface may be eliminated, as discussed with respect to FIG. 12.

Figure 12:
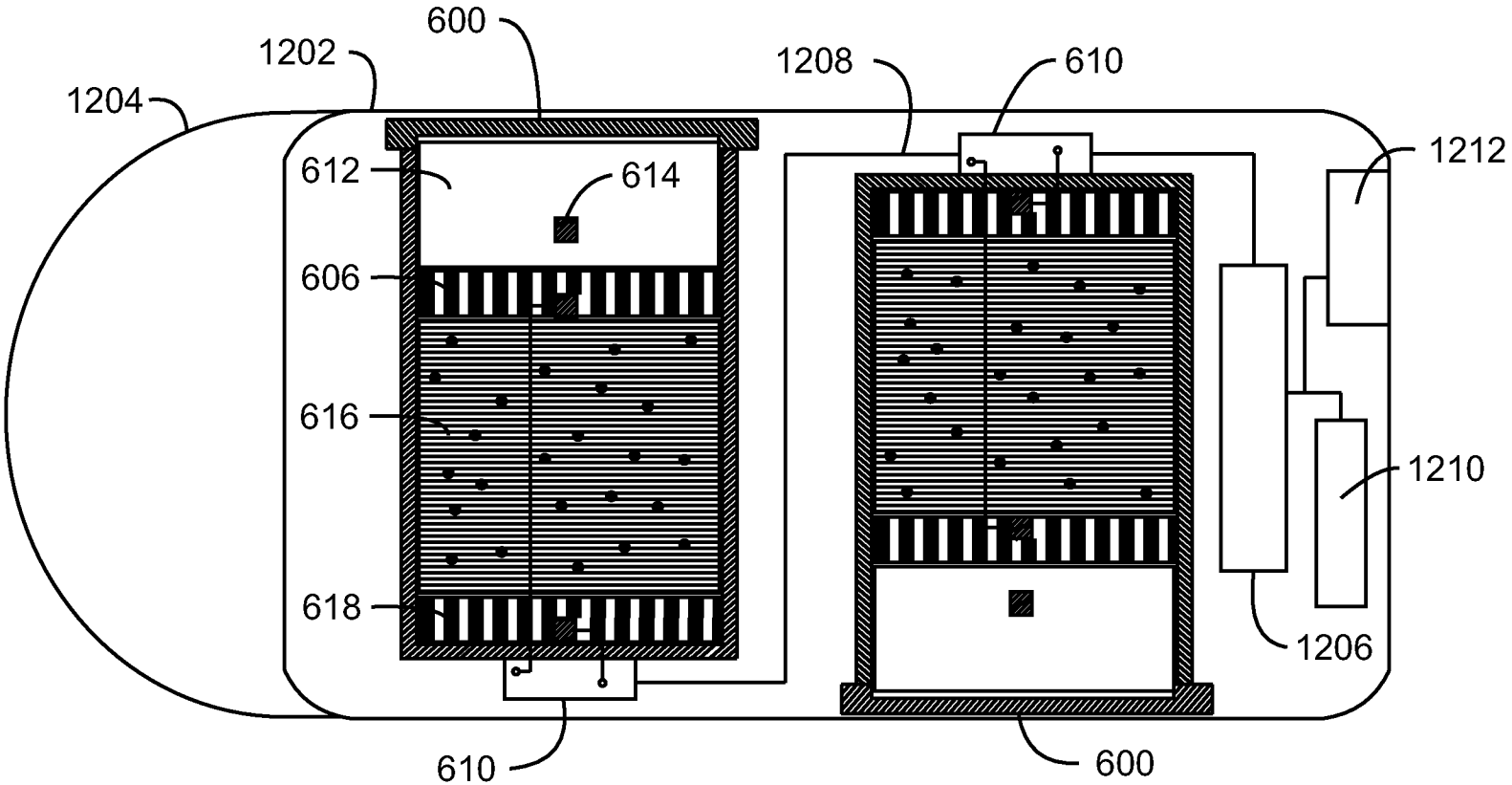
FIG. 12 is a diagram of another tool that can be used to place explosives in a lateral wellbore, in accordance with an exemplary embodiment of the present techniques.

FIG. 12 is a diagram of another tool 1200 that can be used to place explosives in lateral wellbores, in accordance with an exemplary embodiment of the present techniques. The tool 1200 may have a case 1202 having a rounded nose cone 1204. This shape may allow easier insertion of the tool 1200 into lateral wellbores. For example, a fluid carrying a number of the tools 1200 may be flowed into the wellbore, which may result in the tools 1200 being carried into the lateral wellbores. Each tool 1200 may contain one or more squash head charges 600, as discussed with respect to FIG. 6. In other embodiments, the configuration of the explosives may eliminate the proppant 616 and secondary charge 618. Although two squash head explosives 600 are shown in the tool 1200, any number may be included, depending on the flow characteristics desired for the tool 1200. The detonator 610 of each of the squash head charges 600 may be coupled to a control unit 1206, for example, by an internal electrical bus 1208.

The control unit 1206 may be coupled to the surface by a cable, but a cable may not be used in some embodiments. For example, in an exemplary embodiment, the cable is eliminated in favor of a wireless configuration. In this configuration, a power unit 1210, such as a battery pack, may be included to power the control unit 1206. A receiver 1212 may be included in the tool 1200, and coupled to the control unit 1206 to provide the control unit 1206 with a signal to initiate the detonation sequence. The receiver 1212 may include, for example, a pulse detector, an ultrasonic detector, or a sound detector, among others. Thus, the detonation may be initiated by a control signal which may be may be a sequence of pressure waves carried down a fluid column from the surface.

While the present techniques may be susceptible to various modifications and alternative forms, the exemplary embodiments discussed above have been shown only by way of example. However, it should again be understood that the techniques is not intended to be limited to the particular embodiments disclosed herein. Indeed, the present techniques include all alternatives, modifications, and equivalents falling within the true spirit and scope of the appended claims.

What is claimed is:

1. A system for explosive fracturing of a reservoir, comprising:

a squash head charge;

a frame configured to orient the squash head charge towards a rock face in a wellbore in the reservoir;

an internal electrical bus coupled to the squash head charge, wherein the internal electrical bus is configured to carry an ignition signal to a primer charge to detonate the squash head charge;

a controller coupled to the internal electrical bus; and a cable connecting the controller to a surface through the wellbore, wherein the cable is configured to carry a signal to the controller to trigger the ignition signal.

2. The system of claim 1, comprising a receiver coupled to the controller; wherein the receiver is configured to detect a signal pulse to trigger the ignition signal from the controller.

3. The system of claim 2, comprising a portable power source coupled to the controller and the receiver.

4. The system of claim 1, comprising a propellant charge that propels a proppant into fractures induced in the rock face by an explosion of the squash head charge.

5. The system of claim 4, wherein the proppant comprises sand, glass beads, ceramics particles, or any combinations thereof.

6. The system of claim 4, wherein the proppant comprises an energetic material that is configured to detonate in the fractures.

7. The system of claim 1, wherein the frame comprises a case configured to allow the squash head charge to be conveyed into the wellbore by a fluid flow.

8. The system of claim 1, wherein the wellbore comprises a lateral wellbore drilled out from a main wellbore.

9. A method of fracturing rock in a reservoir, comprising:

drilling one or more wells into the reservoir, wherein at least one of the wells comprises a main wellbore with two or more lateral wellbores drilled out from the main wellbore, wherein a centerline at an end of each lateral wellbore that is opposite the main wellbore is within a cone of about 30° of perpendicular to the main wellbore;

placing one or more explosive charges within each of the two or more lateral wellbores; and detonating the explosive charges to generate pressure pulses which at least partially fracture a rock between the two or more lateral wellbores, where the detonations are timed such that one or more pressure pulses emanating from different lateral wellbores interact;

drilling a plurality of main wellbores branching from at least one of the wells, wherein the plurality of main wellbores are substantially parallel to each other, and each of the plurality of main wellbores is coupled to a plurality of lateral wellbores.

10. The method of claim 9, further comprising drilling the lateral wellbores using mechanical bits.

11. The method of claim 9, further comprising drilling the lateral wellbores using water jets.

12. The method of claim 9, further comprising detonating the explosive charges substantially simultaneously.

13. The method of claim 9, further comprising placing a proppant using hydraulic fracturing techniques into fractures induced by the pressure pulses.

14. The method of claim 9, wherein at least one of the plurality of main wellbores is substantially parallel to a direction of minimum horizontal stress in a rock formation.

15. The method of claim 9, wherein at least one of the plurality of main wellbores is substantially perpendicular to a direction of minimum horizontal stress in a rock formation.

16. The method of claim 9, wherein the lateral wellbores are drilled off a main wellbore such that three or more of the lateral wellbores substantially form a plane.

17. The method of claim 16, wherein the plane is substantially horizontal.

18. The method of claim 16, wherein the plane is substantially vertical.

19. The method of claim 9, wherein the explosive charges comprise squash head explosives.

20. The method of claim 9, further comprising detonating the explosive charges in a sequence that has been optimized based on computer simulation of the pressure pulses and a strength and a distribution of nodes of maximum constructive interference.

21. The method of claim 9, comprising placing the explosive charges in the lateral wellbores by flowing a fluid carrying the charges into the lateral wellbore.

22. A method of harvesting production fluids from a subsurface rock formation, comprising:

drilling a well into the formation, wherein the well comprises a main wellbore;

drilling two or more lateral wellbores from the main wellbore, wherein each of the lateral wellbores is substantially perpendicular to the main wellbore;

placing a tool carrying a squash head charge into each of the lateral wellbores;

detonating the squash head charge in a timed sequence configured to allow a shock wave from the squash head charge to interact with a second shock wave from the detonation of another squash head charge; and extracting the production fluids from the subsurface rock formation.

23. The method of claim 22, comprising detonating a propellant charge configured to propel a proppant into fractures created by the detonation of the squash head charge.

* * * * *